US007905749B2

(12) United States Patent
Cleveland

(10) Patent No.: US 7,905,749 B2
(45) Date of Patent: Mar. 15, 2011

(54) GANGED ELECTRICAL OUTLETS, APPARATUS, AND METHODS OF USE

(75) Inventor: Andrew J. Cleveland, Reno, NV (US)

(73) Assignee: Server Technology, Inc., Reno, NV (US)

( * ) Notice: Subject to any disclaimer, the term of this patent is extended or adjusted under 35 U.S.C. 154(b) by 0 days.

(21) Appl. No.: 11/607,185

(22) Filed: Dec. 1, 2006

(65) Prior Publication Data

US 2007/0128927 A1 Jun. 7, 2007

Related U.S. Application Data

(62) Division of application No. 11/355,511, filed on Feb. 15, 2006.

(60) Provisional application No. 60/758,394, filed on Jan. 11, 2006, provisional application No. 60/653,577, filed on Feb. 15, 2005.

(51) Int. Cl.
*H01R 13/60* (2006.01)
*H01R 13/66* (2006.01)

(52) U.S. Cl. ..... 439/535; 439/620.22

(58) Field of Classification Search ..... 439/650, 439/651, 106, 107, 502, 535, 721, 212, 654, 439/620.21, 620.22, 76.1; 200/5 A
See application file for complete search history.

(56) References Cited

U.S. PATENT DOCUMENTS

| | | | |
|---|---|---|---|
| 2,979,624 | A | 4/1961 | Askerneese |
| 3,194,926 | A | 7/1965 | Ustin |
| 3,432,789 | A | 3/1969 | Poehlman |
| 3,588,775 | A | 6/1971 | Poehlman |
| 4,543,557 | A | 9/1985 | Schaefer |
| 4,661,807 | A | 4/1987 | Panaro |
| 4,685,028 | A | 8/1987 | Miller et al. |
| 4,930,047 | A | 5/1990 | Peterson |
| 5,821,636 | A | 10/1998 | Baker et al. |
| 6,045,399 | A | 4/2000 | Yu |
| 6,220,880 | B1 | 4/2001 | Lee et al. |
| 6,232,675 | B1 | 5/2001 | Small |
| 6,394,847 | B2 | 5/2002 | Law |
| 6,406,331 | B1 | 6/2002 | Brown |
| 6,443,746 | B1 | 9/2002 | Yu |
| 6,608,406 | B2 | 8/2003 | Bersiek |
| 6,727,797 | B1 | 4/2004 | Bruchmann |
| 6,750,410 | B2 | 6/2004 | Lee |
| 6,765,158 | B1 | 7/2004 | Morrison et al. |
| 6,781,809 | B2 | 8/2004 | Milanczak |
| 6,826,036 | B2 | 11/2004 | Pereira |
| 6,830,477 | B2 | 12/2004 | Vander Vorste et al. |

(Continued)

FOREIGN PATENT DOCUMENTS

| | | |
|---|---|---|
| EP | 0 641 057 B1 | 10/2009 |

(Continued)

*Primary Examiner* — Felix O Figueroa
(74) *Attorney, Agent, or Firm* — Holland & Hart LLP

(57) ABSTRACT

Ganged-outlet devices are disclosed that can be incorporated and utilized in a power-distribution unit. In one exemplary embodiment, a ganged-outlet device includes a plurality of electrical power outlets that each comprise at least first and second power-connection elements. The device also includes at least one common power line electrically interconnecting the first power-connection elements among the plurality of electrical power outlets. At least one separate, dedicated control power line can be electrically connected to the second power-connection element of each of at least one power outlet among the plurality of electrical power outlets. Power transmitted to the respective second power-connection element of the at least one power outlet via the at least one separate, dedicated control power line is selectively controllable.

14 Claims, 7 Drawing Sheets

U.S. PATENT DOCUMENTS

| | | | |
|---|---|---|---|
| 6,882,530 | B2 | 4/2005 | Cyphers et al. |
| 6,897,379 | B1 | 5/2005 | Hsiao |
| 7,049,973 | B2 | 5/2006 | Torrez et al. |
| 7,137,850 | B2 | 11/2006 | Ewing et al. |
| 7,355,503 | B2 | 4/2008 | Buettner |
| 2002/0052940 | A1 | 5/2002 | Myers et al. |
| 2005/0052814 | A1 | 3/2005 | McNally et al. |
| 2005/0094357 | A1 | 5/2005 | Ewing et al. |
| 2006/0139855 | A1 | 6/2006 | Ewing et al. |

FOREIGN PATENT DOCUMENTS

| | | |
|---|---|---|
| FR | 2268348 | 12/1975 |
| GB | 2266814 | 11/1993 |
| GB | 2266815 | 11/1993 |

GANGED ELECTRICAL OUTLETS, APPARATUS, AND METHODS OF USE

CROSS REFERENCE TO RELATED APPLICATION

This is a divisional application of U.S. patent application Ser. No. 11/355,511, filed Feb. 15, 2006, which claims the benefit of U.S. Provisional Patent Application No. 60/653,577, filed Feb. 15, 2005. These applications are incorporated herein by reference. This divisional application also claims the benefit of U.S. Provisional Patent Application No. 60/758,394, filed Jan. 11, 2006.

FIELD

This disclosure pertains to devices for distributing access to electrical power over multiple "outlets" and apparatus and methods of use. Particular aspects of this disclosure pertain to ganged-outlet devices and modules, some of which are configured to be integrated with one or more other ganged-outlet devices in a power-distribution or other unit useable for distributing electrical power to separate electrical equipment units.

BACKGROUND

A conventional power-distribution unit (PDU) is an assembly of multiple electrical "outlets" (also called "receptacles") that receive electrical power from a source and distribute the electrical power via the outlets to one or more separate electronic equipment units having respective power cords plugged into respective outlets of the PDU. PDUs can be used in any of various applications and settings such as, for example, in or on a rack used for housing and supporting various pieces of electronic equipment.

Certain types of PDUs support remote control of one or more of their respective outlets. This remote control can be accomplished by, for example, by a remote computer communicating through a network with the PDU. Examples of remotely controllable PDUs include products made and distributed by Server Technology, Inc., of Reno, Nev.

One such prior art Server Technology product is the Sentry CDU™ PDU system 100, shown in FIGS. 1A and 1B. The SENTRY CDU PDU includes multiple ganged-outlet modules 102, with each ganged-outlet module having multiple receptacles (outlets) 104 such as IEC C13 receptacles. Each ganged-outlet module 102 includes seven receptacles 104 arranged linearly in a ganged-outlet housing 106 mounted vertically in the PDU system 100 as shown in the FIGS. Each receptacle 104 includes a female ground socket 108, a female neutral socket 110, and a female line ("hot") socket 112. As shown in FIG. 1B, in each ganged-outlet housing 106, all ground sockets 108 are interconnected by a common linear ground rail 114; all neutral sockets 110 are interconnected by a common linear neutral rail 116 parallel to the ground rail 114, and all line sockets 112 are interconnected by common linear line rail 118 also parallel to the ground rail 114. Accordingly, corresponding sockets of adjacent outlets of each ganged-outlet module share a common rail and are not individually controllable.

As shown in FIGS. 1A and 1B, the power rails 114, 116, 118 are external to the respective housings 106. As a result of their external placement, in certain environments, the power rails are exposed to other structure in the vicinity of the power rails. In some applications, the power rails may be vulnerable to unintentional contact with and/or disruption by other components inside the PDU system 100. Whenever multiple ganged-outlet modules 102 are mounted in a housing 120, such as shown in FIGS. 1A-1B, the exposed power rails 114, 116, 118 typically are separated electrically from other components within the housing 120 by means of flexible insulative polymeric sheeting. Thus, in certain embodiments of this type of PDU system 100, the exposed power rails 114, 116, 118 require use of extra insulating material within the PDU system 100. In such embodiments, mis-assembly of the PDU system 100 at time of manufacture or incorrect re-assembly after making a repair to the PDU system 100 may present a risk of electrical shorts.

In addition, the ganged-outlet modules 102 of FIGS. 1A and 1B accommodate only conventional two- or three-pronged connectors such as the IEC C13 receptacles 104 shown. As a result, these types of prior art receptacles typically do not accommodate other types of connectors, such as NEMA connectors.

One conventional PDU system 230 having NEMA compatible receptacles is a Server Technology PDU-VL16™ system, as shown in FIG. 2. In the PDU-VL16 system 230, the NEMA compatible receptacles 232 are not ganged, but rather are mounted and manually wired individually in the PDU housing 234. In this conventional PDU system 230, each individual NEMA receptacle 232 is separately wired to each of three power-supply lines (ground, neutral, and line) inside the housing 234. Separately manually wiring each receptacle 232 can present a number of disadvantages. For example, it can make assembly of the PDU system 230 time-consuming, and thus expensive, expensive to assemble. Separately manually wiring each receptacle 232 can also make such PDU systems 230 less reliable. Also, substantial space must typically be provided inside the housing 234 for each of the receptacles 232, their mounting structures, and their respective wiring.

SUMMARY

The present invention provides, inter alia, a ganged electrical outlet device. Each ganged electrical outlet device can comprise a plurality of interconnected, or ganged, electrical outlets. In one exemplary implementation, each outlet includes a hot socket, neutral socket and ground socket to receive respective hot prongs, neutral prongs and ground prongs of an electrical device power cord. The plurality of power outlets are interconnected by at least one common power rail, line, wire, or other electrical connecting element. In some implementations, the at least one common power rail comprises (i) a first neutral power rail electrically coupled to the neutral sockets of each of the plurality of outlets; and (ii) a second ground power rail electrically coupled to the ground sockets of each of the plurality of outlets. The first neutral power rail and the second ground power rail are configured to transmit a neutral component of a power source to the neutral sockets and a ground component of a power source to the ground sockets, respectively, of each of the plurality of power outlets.

In one exemplary implementation, a separate, dedicated control power line is electrically coupled to the hot socket of each of the plurality of power outlets. Each dedicated control power line can be selectively controllable to allow or prevent transmission of a hot component of a power source to a respective hot socket of one of the plurality of outlets. In other words, the transmission of the hot component of a power source to any one of the outlets can be controlled independent and irrespective of any other of the power outlets. In this manner, power to one of the plurality of outlets can be shutoff, while, for example, power to an adjacent outlet can be turned-on and vice versa. In another example, power to outlets being occupied by a plug of an electrical device requiring power can be turned-on while outlets not occupied by a plug can be turned-off. As can be recognized, a user of the disclosed ganged electrical outlet device can configure the outlets in a variety of ways for a variety of applications.

In some implementations, first ends of the dedicated control power lines are electrically connected to the respective hot sockets of the plurality of outlets and second ends of the dedicated control power lines are electrically connected to a separate connection on a printed circuit board. Each connection can be electrically coupled to a separate circuit on or in the circuit board, with each circuit being coupled to a power regulating device, such as an intelligent power module. The power regulating device acts as a gate to allow, prevent or otherwise control, transmission of the hot component of a power source to a respective outlet.

In specific exemplary embodiments, the ganged-outlet device comprises a plurality of power outlets mounted within a ganged-outlet housing. The least one common power rail interconnecting the plurality of outlets can be disposed within the housing with one end of each of the at least one common power rail disposed external to the housing. The external end can be electrically coupled to the printed circuit board such that a neutral and/or ground component of a power source can be transmitted to the outlets via the at least one common power rail. The second ends of each of the separate, dedicated control power lines can extend external to the housing and be electrically coupled to the printed circuit board to allow electrical interconnectivity between the hot sockets of the outlets and the respective power regulating devices mounted to the printed circuit board.

In other exemplary embodiments, the ganged electrical outlet device comprises a plurality of power outlet housings with each power outlet housing containing one of the plurality of power outlets. The plurality of power outlets are interconnected by at least one power rail extending from outlet housing to outlet housing. In some embodiments, the power outlet housings can be interconnected by a plurality of common, parallel power rails. In some embodiments, one end of the at least one power rail can be electrically connected to the printed circuit board to facilitate transmission of a neutral or ground component from a power source to the outlets via the printed circuit board. Each housing can have a respective separate, dedicated hot component power control line extending therefrom that is electrically connected to a separate circuit on or in the printed circuit board. In some embodiments, each circuit is electrically connected to and controlled by a separate power module, which can activate one or more relays to turn the respective control lines to one or more outlets on and off irrespective of the other outlets.

In some embodiments, the ganged-outlet housing or the power outlet housings can penetrate at least one power outlet passage in an electrical equipment unit. The electrical equipment housing may provide a power distribution unit and, in certain applications, may be mounted within an electrical equipment rack.

In some embodiments, one or more of the outlets may include a NEMA 5-20R compatible power outlet. In some embodiments, one or more of NEMA 5-20R compatible power outlets are compatible with standard three-prong and two-prong electrical power cords for supplying AC power. In some embodiments, one or more of the plurality of electrical power outlets can comprise an IEC compatible outlet.

Use of power rails located inside a ganged-outlet housing or extending between electrical outlet housings can reduce exposure of electrical conductors. Furthermore, the ganged-outlet housing or providing multiple outlet housings can provide insulation between the power rails and lines, and other electrical components within an electrical equipment unit.

In certain embodiments employing the ganged-outlet housing or the multiple outlet housings, the housing or housings can be made from a rigid insulating material. Desirably, the ganged-outlet housing or each of the multiple outlet housings can include a front portion and a rear portion, wherein the rear portion can be extended through a passage in the housing of a power-distribution unit or other apparatus until stopped by the front portion. The ganged-outlet housing or each of the multiple outlet housings can include resilient mounting prongs for securing the housing or housings to the apparatus housing.

In some embodiments, the ganged-outlet device may be fused.

It is to be understood that the foregoing is a brief summary of some aspects of this disclosure or various embodiments. The scope of the present disclosure therefore is not determined by whether any embodiment includes all features or advantages noted above or addresses all issues or deficiencies in the prior art noted above.

In addition, there are additional aspects of the present disclosure. They will become apparent as the specification proceeds.

BRIEF DESCRIPTION OF THE DRAWINGS

The preferred and other embodiments are shown in the attached drawings in which.

DETAILED DESCRIPTION

The various representative embodiments described below are exemplary and are not intended to be limiting in any way.

Figure 3:
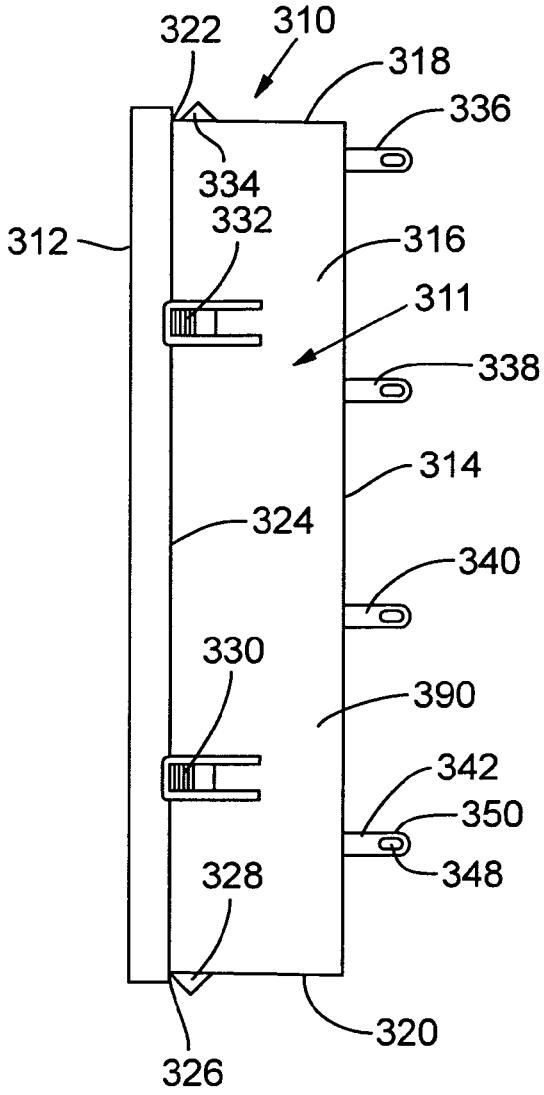
FIG. 3 is a side elevational view of an exemplary embodiment of a ganged-outlet device having multiple NEMA 5-20R outlets.

A first representative embodiment of a ganged-outlet, or ganged-outlet module, 310 is shown in FIG. 3. As used herein, the term "ganged-outlet" or "ganged-outlet module" means a plurality of outlets, or receptacles, pre-arranged in a fixed orientation with respect to each other, and thereby being mountable as a unit in another structure. In the preferred embodiment, the ganged-outlet is mounted in a PDU housing. Ganged-outlet module 310 includes multiple electrical outlets contained within or assembled together with respect to a single housing. The ganged-outlet module 310 can be mounted in or to another housing (e.g., a housing of a power-distribution unit, or "PDU system") configured to contain multiple modules.

As shown in FIG. 3, the ganged-outlet module 310 of this embodiment includes four outlets (456, 458, 460, 462, shown in FIG. 5) each of NEMA 5-20R type, contained in a housing 311. It will be understood that this embodiment, and other embodiments described herein as having NEMA 5-20R type outlets, are exemplary only and that any of various other types of outlets alternatively can be used. For example, the "outlets" can be other NEMA types (e.g., NEMA 5-15R, NEMA 6-20R, NEMA 6-30R or NEMA 6-50R) or any of various EC types (e.g., IEC C13). It also will be understood that all the "outlets" in a particular ganged-outlet module 310, or other ganged-outlet described herein, need not be identical. It also will be understood that the "outlets" are not limited to three-prong receptacles; alternatively, one or more of the "outlets" can be configured for two or more than three prongs in the mating male connector. It also will be understood that the "outlets" are not limited to having female prong receptacles. In any "outlet," one or more of the "prong receptacles" can be male instead of female connection elements, as conditions or needs indicate. In general, as used herein, female and male "prong receptacles" are termed "power-connection elements."

The housing 311 includes a front portion 312 and a rear portion 314. The front portion 312 is substantially planar, and the rear portion 314 is substantially planar and parallel to the front portion 312. The housing 311 also includes longitudinally extending side portions 316 (one of which is viewable in FIG. 3) and transverse end portions 318, 320. The front portion 312, rear portion 314, side portions 316, and end portions 318, 320 are generally orthogonal to each other. The front and rear portions 312, 314 can be made of any suitable, typically rigid, material, most desirably of a rigid polymeric ("plastic") material. In at least certain embodiments, the front and rear portions 312, 314 are made from an electrically insulative material. The side portions 316 and the end portions 318, 320 may be integrally formed, optionally along with the front portion 312 or the rear portion 314. Alternatively, fewer portions of the housing 311 may be integrally formed, and each may be a separate piece, if desired.

The front portion 312 desirably is slightly wider and longer than the rear portion 314 so as to form a shoulder 322, 324, 326 about the perimeter of the front portion 312. The shoulder 322, 324, 326 may be used for mounting the housing 311 to a housing of a PDU system (not shown).

In the depicted embodiment, the side portions 316 and end portions 318, 320 each include one or more respective outwardly projecting, resilient prongs or locking tabs, e.g., 328, 330, 332, 334. Each resilient prong 328, 330, 332, 334 may be integrally formed in a respective surface of the side portions 316 and/or end portions 318, 320, such as by incorporation into a mold for the side and/or end portions. For example, each resilient prong 328, 330, 332, 334 may be a cantilevered tab, the end of the tab having an outward pointing wedge, formed by gaps between the tab and its surrounding structure on at least a portion of three sides of the tab. Alternatively, the resilient prongs 328, 330, 332, 334 can be separate devices attached to the housing 311. Each resilient prong 328, 330, 332, 334 is configured to be depressed inwardly (toward the interior of the housing 311).

The resilient prongs 328, 330, 332, 334 may used to facilitate mounting the housing 311 to a housing of a PDU system. Specifically, the front portion of a PDU-system housing (not shown) may be provided with a cutout having dimensions conforming to, but slightly longer and wider than, the rear portion 314 and slightly shorter and narrower than of the front portion 312 (including its shoulder portions 322, 324, 326). Thus, the housing 311 is slidably inserted (rear portion 314 first) into the cutout until stopped by the shoulder 322, 324, 326. Meanwhile, as the prongs 328, 330, 332, 334 engage the edge of the cutout, they are depressed inwardly until insertion progresses past the apices of the prongs 328, 330, 332, 334, at which time the prongs 328, 330, 332, 334 relax outwardly against the edges of the cutout. When the housing 311 is fully inserted such that the shoulder 322, 324, 326 is in contact with the surface of the front panel of the PDU-system housing, the prongs 322, 330, 332, 334 are at their respective fully outwardly biased positions as shown in FIG. 3, which firmly engage the prongs against the respective edges of the cutout and firmly seats the shoulder 322, 324, 326 against and to the front pane of the PDU-system housing. To remove the module 310 from the PDU-system housing, the prongs 328, 330, 332, 334 are urged inwardly (toward the interior of the housing 311) sufficiently to allow the prongs 328, 330, 332, 334 (as the housing 311 is pulled away from the cutout) to clear the respective edges of the cutout.

It will be understood that the depicted number and arrangement of the prongs 322, 330, 332, 334 are exemplary only and are not intended to be limiting. In alternative embodiments, more or fewer prongs may be appropriate, and it may not be necessary to include at least one prong on each surface 316, 318, 320. For example, in some applications, the end surfaces 318, 320 may not have respective prongs 328, 334. Furthermore, it will be understood that any of various other attachment schemes alternatively can be employed, instead of the prongs 322, 330, 332, 334, for mounting the housing 311 to a housing of a PDU system or other device incorporating the ganged-outlet module 310. For example, any of various mounting brackets and clamps could be used.

The ganged-outlet module 310 includes a plurality of electrically conductive connection terminals, or connectors, 336, 338, 340, 342, 344, 346 for making respective electrical connections. The connection terminals 336, 338, 340, 342, 344, 346 extend rearwardly from (and desirably normal to) the rear portion 314 of the housing 311. The connection terminals 336, 338, 340, 342, are used for making respective line connections to respective outlets 456, 458, 460, 462 (FIG. 5), and are linearly arrayed vertically from the upper end 352 of the housing 311 to the lower end 354. The connection terminals 336, 344, 346 are linearly arrayed horizontally near the upper end 352 of the housing 311. The connection terminal 336 is used for making a respective line connection to the outlet 456, and the connection terminals 344 and 346 are used for making parallel ground and neutral connections, respectively, to all the outlets 456, 458, 460, 462 of the ganged-outlet module 310.

Figure 4:
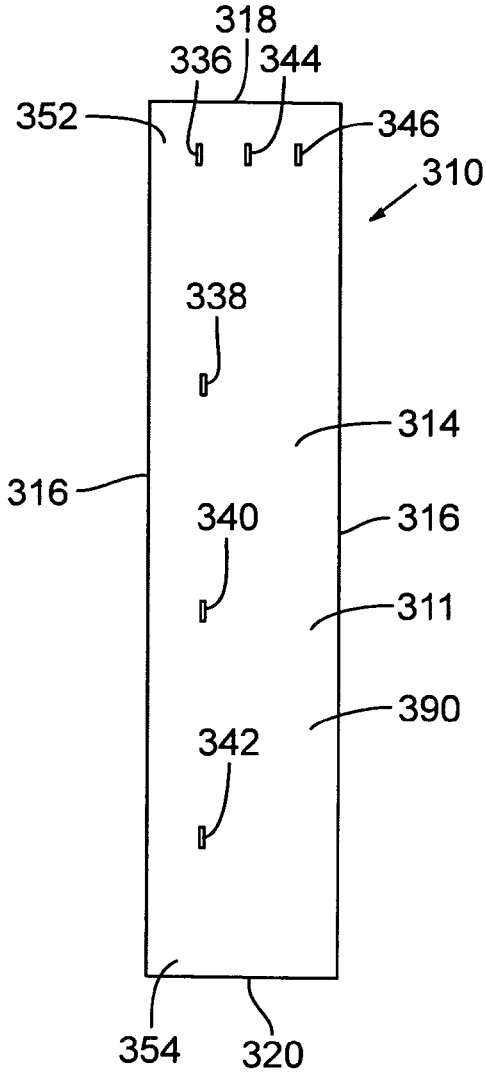
FIG. 4 is a plan view of the rear surface of the embodiment shown in FIG. 3.

Each of the outlets 456, 458, 460, 462 in the depicted embodiment has a separate respective line-connection terminal 336, 338, 340, 342 to allow independent control (e.g., switching) of power supplied to the respective outlet. By way of example, a respective on-off switch (not shown in FIG. 4 or 5) can be electrically interposed between each of the line-connection terminals 336, 338, 340, 342 and a source of line power. The switches can be manually or electronically actuated, for example. As an example of the latter, the switches can be configured electromechanically such as respective relays, or configured entirely electronically such as respective switching transistor circuits.

As an alternative to the depicted embodiment, groups of two or more outlets (e.g., a first group consisting of outlets 456, 458 and a second group consisting of outlets 460, 462) can have their own respective line-connection terminals. Thus, in accordance with this example, a single line-connection terminal can be used to turn on and off both outlets 456, 458, and a single line-connection terminal can be used to turn on and off both outlets 460, 462. Other groupings of outlets are, of course, possible in accordance with the particular setting or conditions in which the ganged-outlets are to be used. For example, a single line-connection terminal could be used turn on and off all of the outlets in a particular ganged-outlet.

A respective wire-mounting orifice 348 is defined near the respective distal end 350 of each connection terminal 336, 338, 340, 342, 344, 346. The wire-mounting orifice 348 facilitates secure attachment of the respective wire (not shown) supplying power to each particular connection terminal. For example, the respective wire can be connected to each connection terminal by first inserting the free end of the wire through the respective orifice 348 and then wrapping the free end around the respective connection terminal, followed by soldering the resulting connection. It will be understood that other methods of making wire connections alternatively can be used.

As a first example, the ends of the line wires, ground wire, and neutral wire can be fitted with female spade lugs adapted to slip onto the respective connection terminals 336, 338, 340, 342, 344, 346 (which are shown as having a male spade-connector configuration). In some implementations, the female spade lugs can be mounted to a printed circuit board (not shown) and electrically coupled to circuitry on or in the printed circuit board. In a second example, the connection terminals 336, 338, 340, 342, 344, 346 can be configured with any of various female configurations adapted to accept corresponding male connector terminals fitted to the wire ends. In a third example, the connection terminals 336, 338, 340, 342, 344, 346 can be provided with connector screws configured for making respective screw connections with the respective wire ends. It will be understood that any of various other connector schemes known in the art alternatively can be used.

As noted above, the depicted embodiment includes connection terminals (e.g., item 336). It will be understood that other embodiments alternatively can have any of various other types of electrical-connection schemes to the outlets 456, 458, 460, 462. For example, connection schemes can be based on spade, lug, or plug connectors, screw connectors, or other suitable type of connector, as discussed above. Furthermore, if desired, one or more of these electrical connectors can be located inside the housing 311 instead of outside the housing as shown in the depicted embodiment. Further alternatively, one or more of these electrical connectors can be located between barrier walls or ridges or other separating structures formed on, or mounted to, the housing 11.

Figure 5:
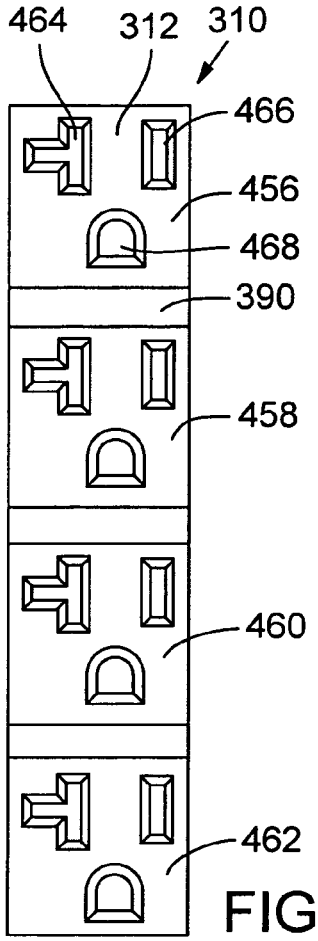
FIG. 5 is a plan view of the front surface of the embodiment shown in FIG. 3.

FIG. 5 depicts the front portion 312 of the ganged-outlet housing 311 of the subject embodiment. As discussed above, in the depicted embodiment, four NEMA 5-20R outlets 456, 458, 460, 462 are defined in the front portion 312 of the housing 311. In certain embodiments, if the front portion 312 is molded of a suitable rigid plastic material, the mold for the front portion 312 is configured to form all the respective outlets in an integral and unitary manner with the front portion 312.

The outlets 456, 458, 460, 462 may be, if desired, molded or formed, or otherwise mounted, within the housing 311 (e.g., to the front portion 312) such that adjacent outlets are very close to or even touching each other, and if desired even abutting each other, in a linear array as shown. For example, spacer plates 390 can be positioned between each adjacent outlet to maintain equal spacing between the outlets. Placing the outlets in such close proximity to one another allows the housing 311 to be made as small as possible for mounting in or to the housing of a PDU system (comprising multiple ganged-outlet modules 310). Thus, the housing 311 desirably is made to occupy less volume than otherwise would be collectively occupied by an equivalent number of individual outlets separately mounted in a PDU system in the conventional manner.

Also, the manner of electrically interconnecting the ganged-outlets 456, 458, 460, 462 in the module 310, as described above, results in less individualized wiring and the like that otherwise would be required for connecting an equivalent number of outlets, mounted in a PDU system in the conventional manner, to electrical power. Furthermore, mounting the ganged-outlet module 310 into a housing of a PDU system requires substantially less time and effort than individually mounting separate outlets in a PDU system (or other apparatus including multiple outlets) in the conventional manner.

Each outlet 456, 458, 460, 462 includes a respective neutral-prong socket 464, a respective line-prong ("hot-prong") socket 466, and a respective ground-prong socket 468. The neutral-prong sockets 464 are all electrically connected together in parallel by a first power rail or wire (not shown, but see discussion of FIGS. 6A-6C below) inside the housing 311 to the neutral-connection terminal 346. Similarly, the ground-prong sockets 468 are all electrically connected together in parallel by a second power rail or wire (not shown, but the second power rail can be similar to the first power rail shown in FIGS. 6A-6C) inside the housing 311 to the ground-connection terminal 344. Each line-prong socket 466 is electrically connected inside the housing 311 to its respective line-connection terminal 336, 338, 340, 342. Thus, in a PDU system in which the ganged-outlet module 310 is mounted, line power to each outlet 456, 458, 460, 462 can be individually controlled, for example by connecting line power to the respective connection terminal 336, 338, 340, 342 via a respective switch (not shown).

Figure 6A:
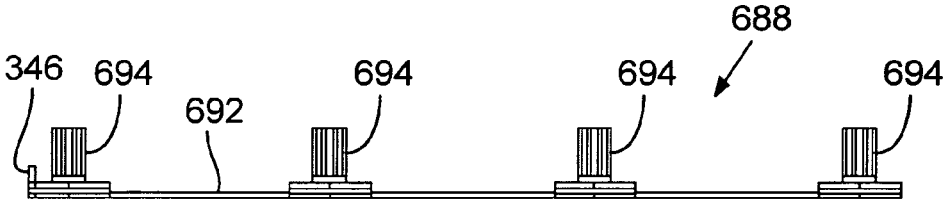
FIGS. 6A-6C present orthogonal views of an exemplary power rail used in the embodiment of FIG. 3.
Figure 6B:
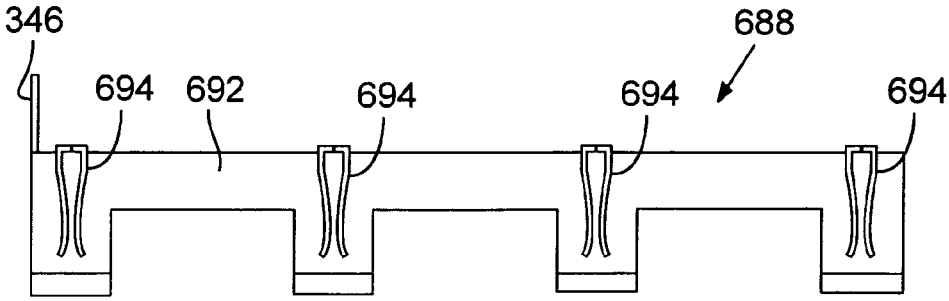
Figure 6C:
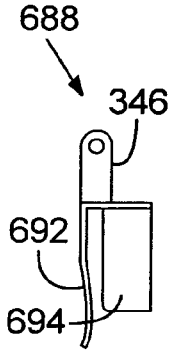

FIGS. 6A-6C depict an exemplary embodiment of a power rail 688 that can be used in the ganged-outlet module 310 described above. The power rail 688 can be a neutral power rail and comprise a longitudinal power-bus portion 692 from which four neutral-connection elements 694 extend. Also extending from the power-bus portion 692 is the neutral-connection terminal 346.

Figure 7:
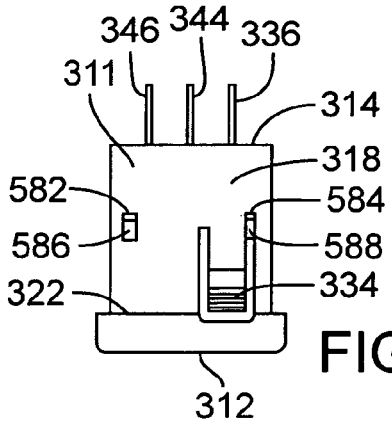
FIG. 7 is a first-end view of the embodiment shown in FIG. 3.
Figure 8:
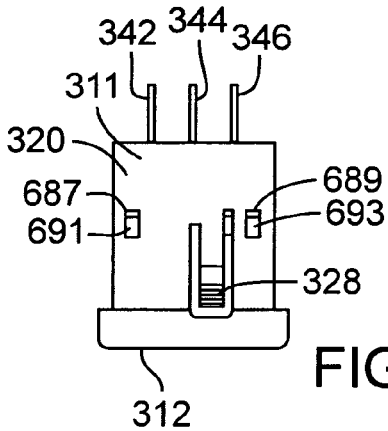
FIG. 8 is a second-end view of the embodiment of FIG. 3.

Turning now to FIGS. 7 and 8, the end portions 318 and 320, respectively, of the housing 311 are shown. In FIG. 7, the resilient prong 334 and shoulder 322 can be seen, as well as the connection terminals 336, 344, 346. In FIG. 8, the resilient prong 328 and shoulder 326 can be seen, as well as the connection terminals 342, 344, 346. The end surface 318 (FIG. 7) defines first and second orifices 582, 584, respectively, which can be used to secure various parts 586, 588 of the housing 311 together. Similarly, the end surface 320 (FIG. 8) defines first and second orifices 687, 689, respectively, which can be used to secure various parts 691, 693 of the housing 311 together. The power rails (not shown) are securely mounted within the housing 311 and are electrically isolated from each other and from the front portion 312 of the housing 311.

Whereas the embodiments of FIGS. 3-8 depict a ganged-outlet module 310 having four outlets 456, 458, 460, 462, it will be understood that this number of outlets is exemplary only. Other embodiments of the ganged-outlet module 310 have different respective numbers of outlets (more or less) as needed or desired.

Figure 1A:
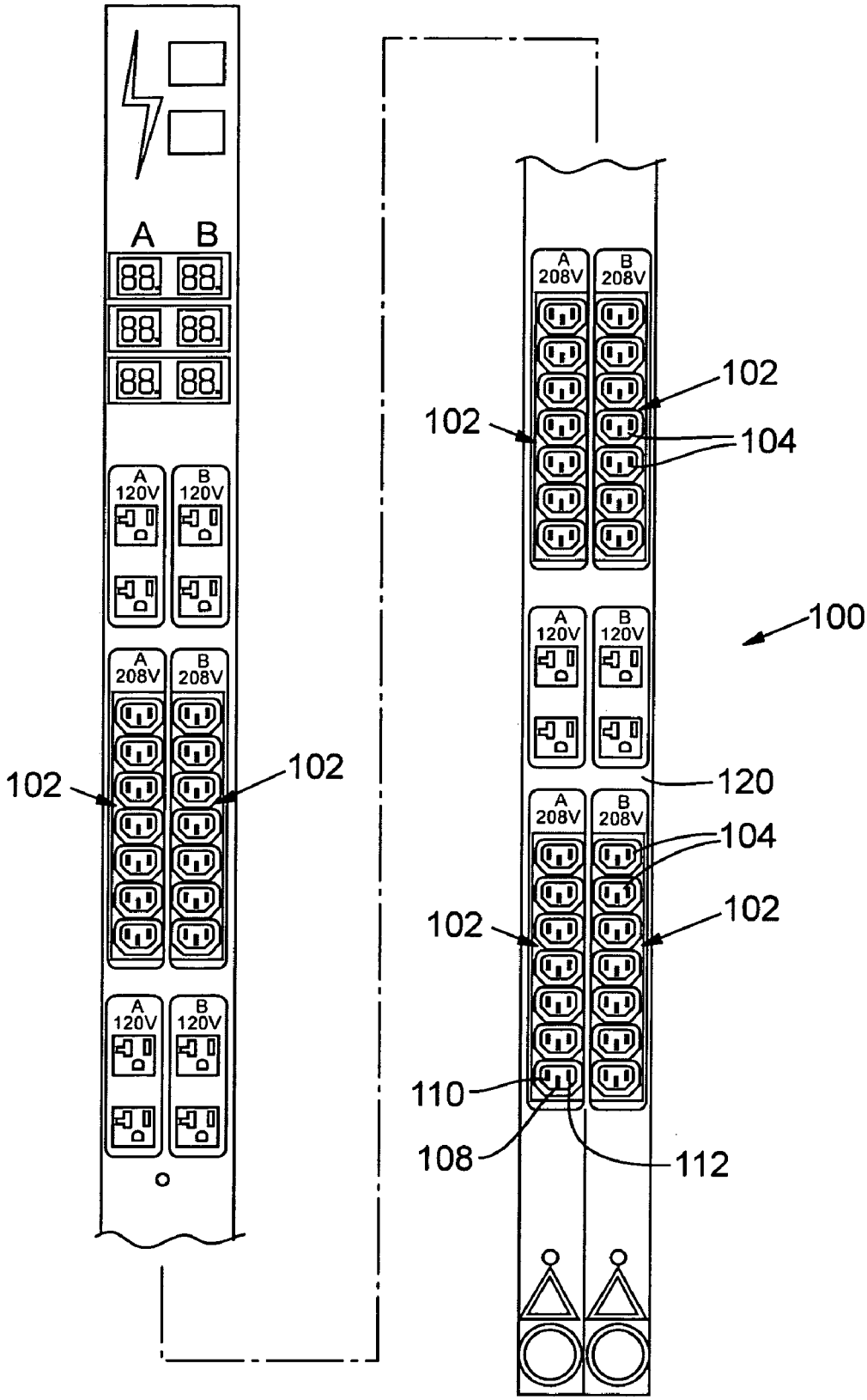
FIG. 1A (Prior Art)
FIG. 1A is a plan view of the front surface of an exemplary embodiment of a power-distribution unit (PDU) comprising multiple ganged-outlet modules.
Figure 1B:
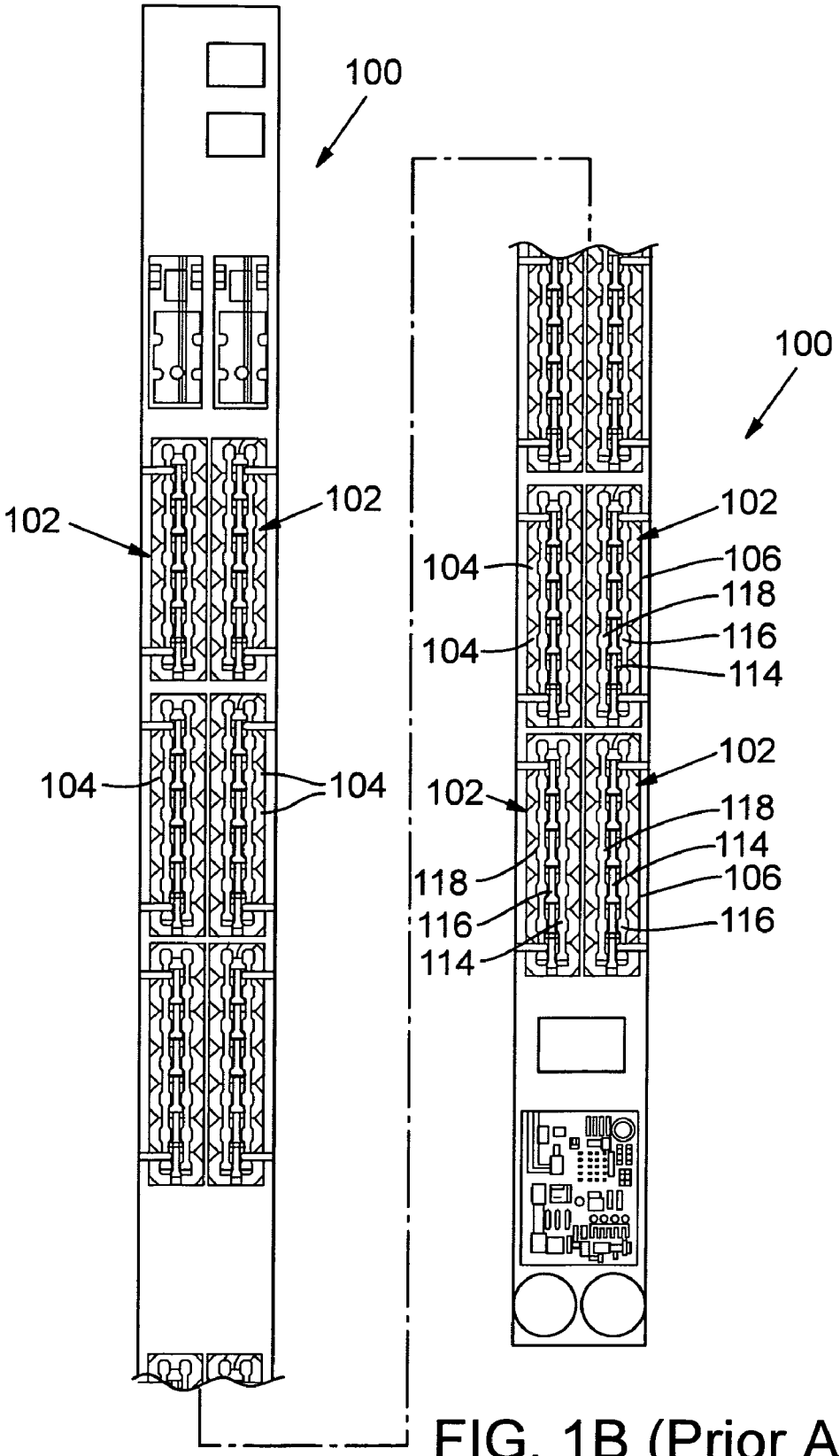
FIG. 1B (Prior Art)
FIG. 1B is a plan view, from behind, of the front surface of the embodiment shown in FIG. 1A, revealing details of power rails interconnecting the outlets together in each ganged-outlet module.
Figure 9:
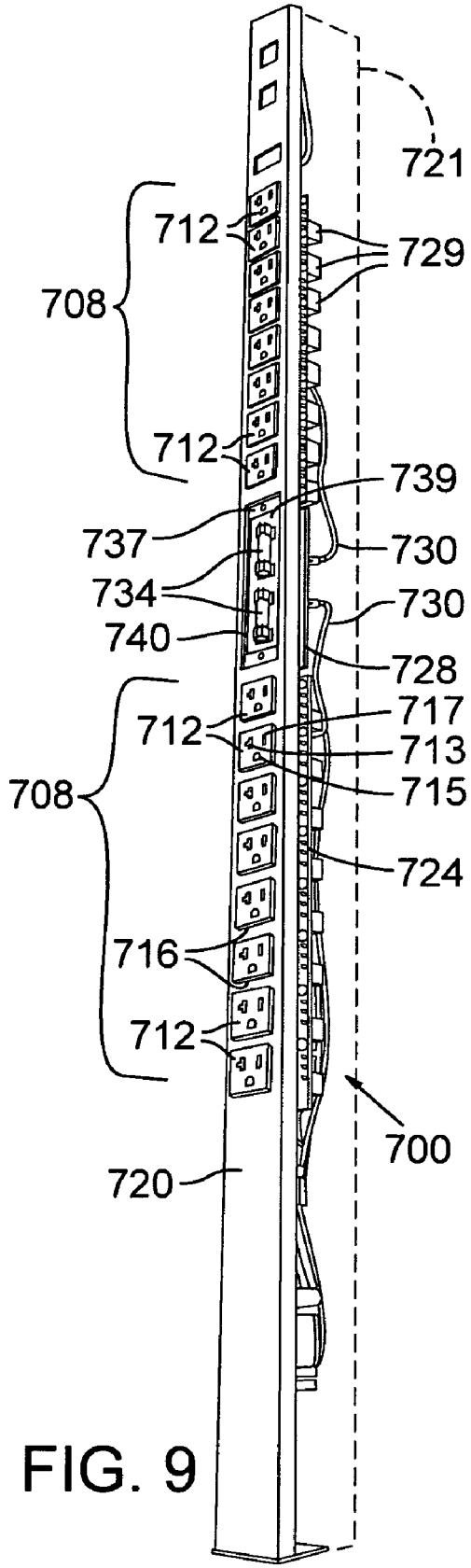
FIG. 9 is an elevational perspective view of a PDU apparatus with multiple ganged-outlet devices having multiple outlet housing with each housing providing a power outlet, and shown with a portion of the apparatus housing removed.
Figure 2:
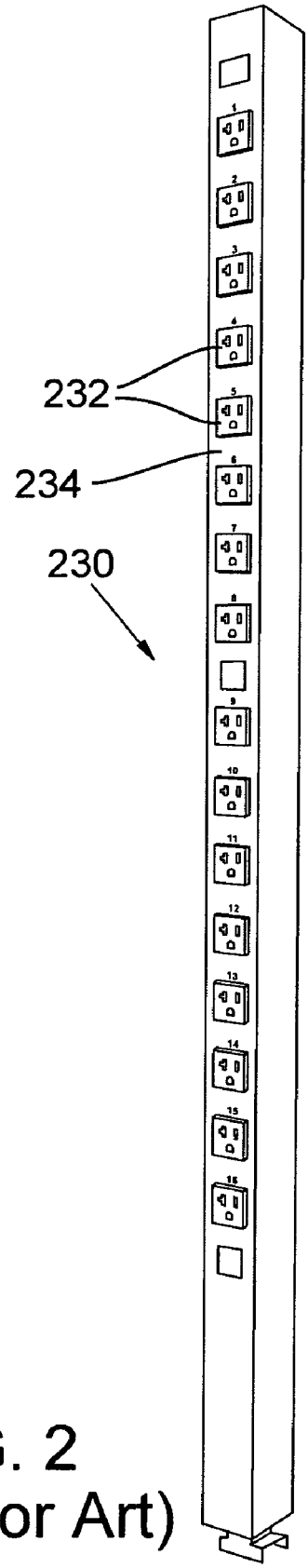
FIG. 2 (Prior Art)
FIG. 2 is an elevational perspective view of a conventional PDU system including multiple individual outlets.

FIG. 9 shows a power distribution unit 700 having an alternate exemplary embodiment of a ganged-outlet 708. The power distribution unit 700 has two outlet gangs 708, each ganged-outlet 708 has a plurality of interconnected outlets 712 extending through apertures 716 in a housing front section 720 (housing rear section 721 extending opposite and parallel to the housing front section shown removed) of the power distribution unit 700. Although the outlets 712 are shown as being NEMA 5-20R outlets, any outlet style could be used. For example, the outlets can be other NEMA types (e.g., NEMA 5-15R, NEMA 6-20R, NEMA 6-30R or NEMA 6-50R) or any of various IEC types (e.g., IEC C13 or IEC C19). It also will be understood that all the outlets in a particular ganged-outlet 708 need not be identical.

Each of the outlets 712 in a respective outlet gang 708 is connected to a circuit board 724 disposed generally parallel to the housing front section 720. The circuit board 724 is mounted within the housing 720 and spaced away from the housing front section 720 by nonconductive elongate spacing elements 725 that extend transversely to the circuit board and are coupled to a nonconductive footing 727 mounted to the circuit board (see FIG. 10). The circuit board 724 can be electrically connected to fuse board 728 by one or more wires. For example, in one implementation, the circuit board 724 is electrically connected to the fuse board 728 by an AC power control wire 730 (see FIG. 10) and neutral power supply wire 733. Further, the power distribution unit can include intelligent power modules having electromechanical relays, e.g., 729, electrically connected to the circuit board 724 with each operable to monitor and/or control the power transmitted to a respective individual outlet 712.

Two fuses 734 are connected to the fuse board 728, with each fuse 734 fusing a respective outlet gang 708 and its associated outlets 712. The fuses 734 and fuse board 728 are mounted within an aperture 740 penetrating the housing front section 720 at a location intermediate the two outlet gangs 708. Accordingly, the fuse board 728 and associated fuses 734 are accessible through the aperture 740. The aperture 740 includes mounting tabs 737 to which a clear or at least partially transparent window 739 can be mounted to allow a user to view the fuses 734 yet provide protection from contact with external objects.

Figure 10:
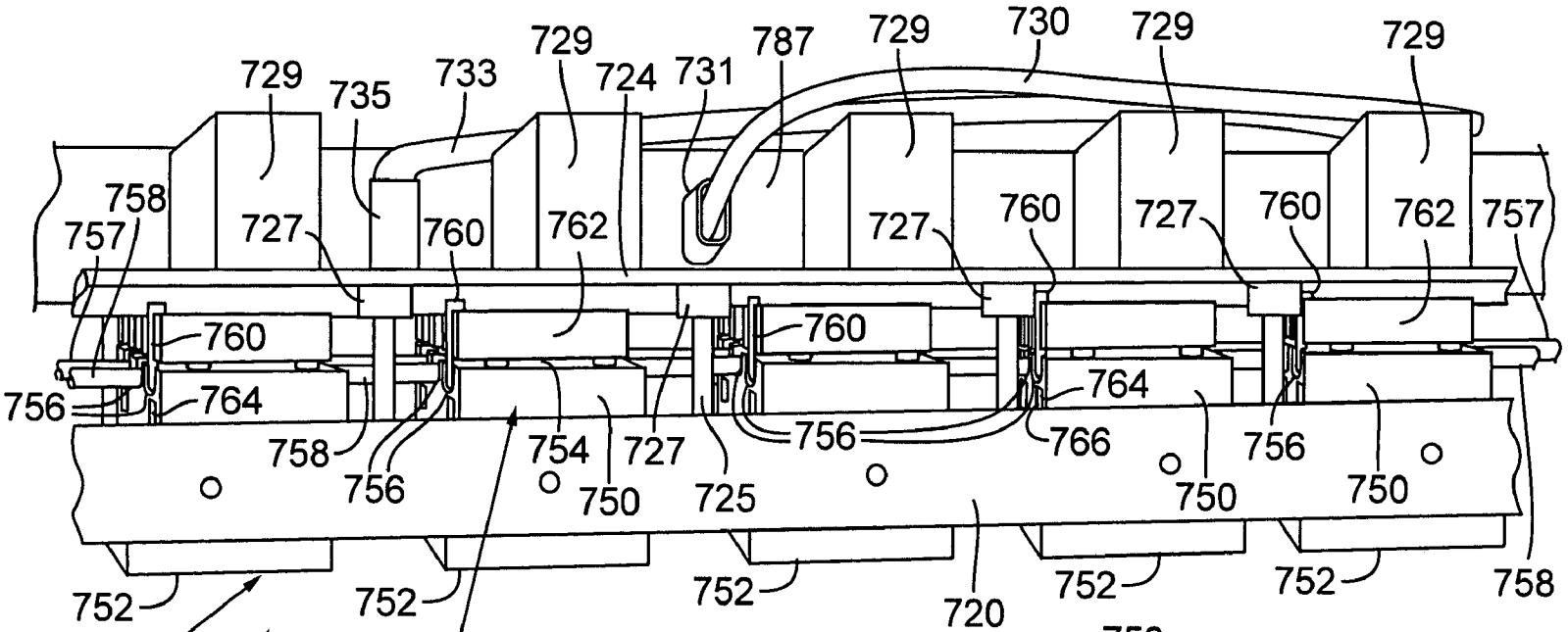
FIG. 10 is a fragmentary perspective view of the PDU apparatus of FIG. 9.
Figure 11:
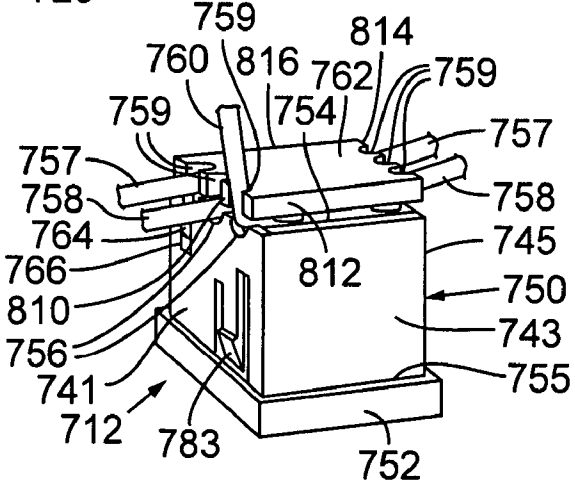
FIG. 11 is a perspective view of an outlet housing exemplary of the outlet housings shown in FIG. 10.

Referring to FIGS. 10 and 11, each outlet 712 of the outlet gang 708 can have a generally rectangular shaped housing 750 having a generally planar outlet receptacle end portion 752 and four generally planar sides 741, 743, 745, 747 extending generally transversely or perpendicularly from the outlet end portion to an open end portion 754. The receptacle end 752 desirably is slightly wider and longer than the open end portion 754 to form a shoulder 755 about the perimeter of the front receptacle end 752. The shoulder may used for mounting the housing 750 to housing front section 720 of PDU 700.

The sides of the housing 750 can include one or more respective outwardly projecting, resilient prongs of locking tabs. For example, in the illustrated embodiments, locking tab 783 is integrally formed in a surface of side portion 783, and although not shown, a locking tab can be integrally formed in a surface of side portion 745. Resilient locking tab 783, being exemplary of the locking tabs of the illustrated embodiments, can be a cantilevered tab, the end of the tab having an outward pointing wedge, formed by gaps between the tab and its surrounding structure on at least a portion of the three sides of the tab. Of course, in other embodiments, the locking tabs can be separate devices attached to the housing 750. Resilient locking tab 783 is configured to be depressed inwardly (toward the interior of housing 720).

The resilient tabs, such as tab 783 can be used to facilitate mounting the outlets 712 to housing 750. This can be accomplished in a manner similar to that described in detail above for securing resilient prongs 328, 330, 332, 334 of the housing 311 to cutouts of a PDU system as shown in FIG. 3. In other words, each outlet aperture 716 can be sized such that the housing 750 can be inserted (open end portion 754 first) into a respective aperture 716 until stopped by the shoulder 755. As this is occurring, the locking tab, or tabs, 783 engages an edge of aperture 716, is depressed inwardly until insertion progresses past the apice of tab 783, at which time the tab 783 relaxes outwardly against an edge of the aperture. In this manner, the locking tabs 783 facilitate seating the shoulder 755 against and to a front surface of PDU housing front section 720. The outlet housings 750 can be removed from respective apertures 716 in a manner similar to that described above in relation to FIG. 3 for the removal of module 310 from the PDU-system housing.

The outlet receptacle end portion 752 includes three power component sockets 713, 715, 717 formed therein and extending sized to receive a respective power component prong of an electronic device power plug. For example, socket 713, 715, 717 can be neutral, ground and hot power component sockets, respectively, sized to receive a neutral, ground and hot prong, respectively, of an electronic device plug.

Two opposing planar sides 741, 745 can each have multiple wire receiving housing recesses 756 coextensive with an outer edge of the open end portion 754. The recesses 756 can be generally semi-circular shaped to receive power transmitting wires, such as exemplary wires 757, 758, 760, which can each transmit a component of AC power, e.g. a neutral, ground or line, i.e., hot, component, respectively, from a power source to an outlet or from one outlet to an adjacent outlet. In the illustrated embodiment, exemplary wires 757 transmit a neutral component of an AC power source, exemplary wires 758 transmit a ground component of an AC power source and exemplary wires 760 transmit a line component of an AC power source. As used herein, the wires can be either one piece of a continuous stretch of wire or a series of coupled wires.

Wire 730 can be electrically coupled to the fuse board 728 at a first end and electrically coupled to the printed circuit board 724 at a second end. More specifically, the second end of the wire 730 is removably secured to a wire receptacle 731 in electrical communication with a circuit board 787 that is electrically connected to the printed circuit board 724. The wire 730 transmits a low current neutral power supply from a power source (not shown) to the circuit board 787. In one example, the circuit board 787 extends generally parallel and transversely to the printed circuit board 724 along at least a substantially length of the circuit board 724.

One or more microprocessors (not shown), such as an IPM core logic and execution unit, can be mounted to the circuit board 787 and powered by the low current neutral power supply being transmitted to the board via wire 730. The microprocessors can be in electrical communication with one or more relays 729 and a master communications module (not shown) via a bus, such as an I2C bus. The master communications module can control the microprocessors, which in turn control the regulatory function of the one or more relays 729.

The PDU 700 can also include an AC power supply wire or cable 733 that has a first end coupled to a power source and a second end removably secured to the printed circuit board 724 via a receptacle 735 mounted on the printed circuit board. In the illustrated embodiments, the AC power supply wire transmits the ground, neutral and line components of AC line power from the power source to the printed circuit board 724.

In one specific exemplary implementation, a power distribution unit of the present application can include multiple sets of ganged-outlets with each set having four outlets. For every set, power to each of the four outlets is regulated by a respective one of four relays, with each of the four relays being in electrical communication with a single microprocessor. In other words, a single microprocessor mounted to a board, such as printed circuit board 787, controls the four relays associated with the four outlets of a given set of ganged-outlets. In this implementation, a separate AC power supply wire or cable is provided for each set of ganged-outlets. In other words, at least one AC power supply cable is electrically connected to a printed circuit board, such as printed circuit board 724, every four outlets, or relays, to provide power to the outlets of a respective set of outlets.

In general, the printed circuit board 724 can have one or more power lines and/or power control lines in power receiving communication with a respective power component of the power source. As will be described below, each power control line is electrically coupled to one or more electrical relays, intelligent power modules, or other power regulating or controlling device.

Figure 12:
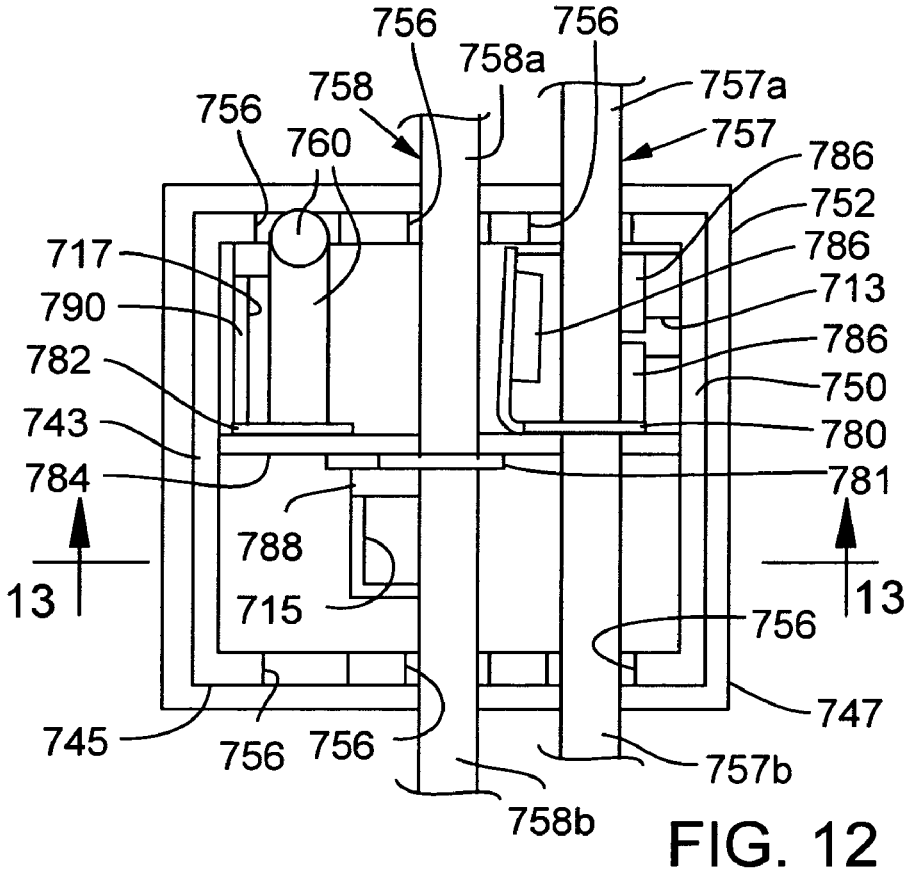
FIG. 12 is a top view of the outlet housing of FIG. 11 shown with an end cap removed.
Figure 13:
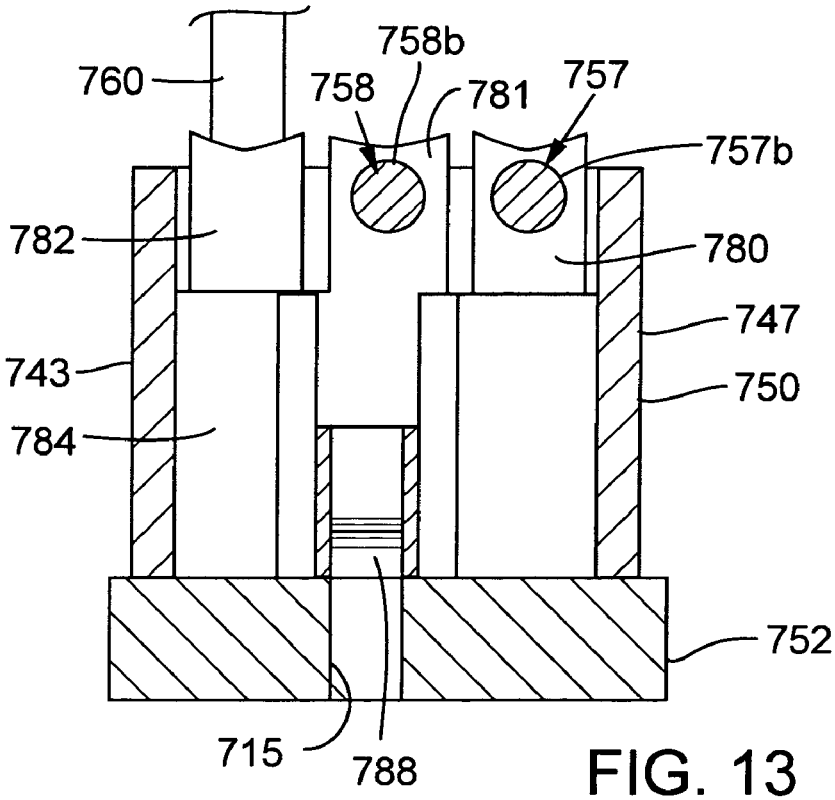
FIG. 13 is a cross-sectional side view of the outlet housing of FIG. 12.

Referring to FIGS. 12 and 13, the wires 757, 758, 760 can be electrically coupled to a respective socket terminal 780, 781, 782 mounted at least partially within a respective socket 713, 715, 717, of housing 750. The housing 750 can include an interior wall 784 extending within the housing from side 743 of the housing to the opposite side 747 of the housing and extending parallel to the sides 741, 745 of the housing. Terminal 780, being electrically connected to neutral component wires 757, comprises a neutral component terminal. Plug contact portions 788 of terminal 780 are at least partially disposed within or adjacent the neutral power component socket 713 of the housing 750. Terminal 781, being electrically connected to ground wires 758, comprises a ground component terminal. A plug contact portion 790 of terminal 781 is at least partially disposed within or adjacent the ground power component socket 715 of the housing 750. Terminal 782, being electrically connected to a line, or hot, component wire 760, comprises a line component terminal. A plug contact portion 786 of terminal 782 is at least partially disposed within or adjacent the line power component socket 717 of the housing 750.

The plug contact portions 786, 788, 790 of the terminals 780, 781, 782, respectively, are contacted by the prongs of a plug inserted through the power component sockets 713, 715, 717 in the housing 750 to establish electrical connectivity between the terminals and the prongs of the plug. For example, a ground prong of a plug of an electrical device inserted into the ground power component socket 715 contacts the plug contact portion 788 of terminal 781 to establish electrically connectivity between the ground prong of the plug and the ground component terminal 781.

As shown in FIG. 12, neutral wire 757 can be comprised of several individual lengths of wire, such as first length of wire 757*a* and second length of wire 757*b*. The first length of wire 757*a* is electrically connected to a first side of terminal 780 at a first end and electrically connected to a ground terminal of a first adjacent receptacle (not shown) at a second end. The second length of wire 757*b* is electrically connected to a second side of terminal 780 at a first end and electrically connected to a ground terminal of a second adjacent receptacle. In this manner, the neutral terminals of each receptacle or outlet 712 are electrically connected together in parallel by multiple lengths of wire 757 to form wire or rail 757.

Similarly, ground wire 758 can be comprised of several individual lengths of wire, such as first length of wire 758*a* and second length of wire 758*b*. The lengths of wire 758*a*, 758*b* are connected to terminal 781 at first ends and adjacent terminals at second ends in a manner similar to that described for wire lengths 758*a*, 758*b*. Accordingly, ground terminals of each receptacle or outlet 712 are electrically connected together in parallel by multiple lengths of wire to form wire or rail 758.

In some implementations, the wires 757, 758 can be a single length of wire or comprise a rail-like structure similar to rail 688 shown in FIGS. 6A-6B.

As shown in FIGS. 10, 12 and 13, wire 760 is electrically connected to terminal 782 inside the housing 750 at a first end and electrically connected to the circuit board 724 at a second end. As shown in the illustrated embodiments, the wire 760 extends from a socket terminal 782 in a direction generally parallel to the circuit board 724. Proximate the surface 741 of the housing 750, the wire 760 can be bent at an angle of approximately 90-degrees, to extend generally perpendicular to and towards the circuit board.

The second end of the wire 760 opposite the first end can then be electrically coupled or otherwise soldered to the printed circuit board 724. The second end can be connected to one or more power control lines on or in the printed circuit board 724 to establish electrical power receiving communication with a line component of a power source. Preferably, the wires 760 of each of the respective multiple outlets 712 are connected to separate power control lines each individually electronically connected to a line component of a power source. In other words, line power can be supplied to each receptacle 712 of a ganged-outlet 708 irrespective of other receptacles 712 of the ganged-outlet via separate power lines of the printed circuit board. Desirably, each power control line is electrically connected to a respective intelligent power module or relay 729. Each relay 729 can be individually and selectively controlled to regulate the line power to a respective line socket terminal 782 and thus the line power to an electrical device plugged into the corresponding outlet 712.

Although an intelligent power module is shown 729, it is recognized that any of various switches electrically interposed between each of the line terminal 782 and the source of line power can be used. The switches can be manually or electronically actuated, for example. As an example of the latter, the switches can be configured electromechanically such as respective relays, or configured entirely electronically such as respective transistor circuits.

Alternatively, in applications where individually controlled outlets are not desired or necessary, instead of one separate portion of transmitting wire 760 for each respective outlet connected to the circuit board, wiring connections to the circuit board can be reduced by electrically connecting one or more line terminals in parallel by multiple lengths or a single length of transmitting wire 760 extending from outlet to outlet in a manner similar to that describe above regarding the interconnectibility of wires 757, 758 with neutral terminals 780 and the ground terminal 781 of the outlets.

Referring back to FIG. 11, each outlet 712 includes an outlet end cap 762 removably secured to the open end 754 of the outlet housing 750. The end cap 762 can have a generally rectangular shape with a generally closed planar end and four generally planar sides 810, 812, 814, 816 extending generally transversely or perpendicularly from the closed planar end to an open end opposite the closed end.

The end cap 762 can include one or more outwardly projecting, resilient prongs or locking tabs, e.g., 764. Each resilient prong 764 may be integrally formed in end cap 762 and extend generally transversely from the closed planar end of the end cap 762 toward the open end of the cap. The end of the prongs 764 away from the closed end of the cap can each have an outwardly pointing notch. Each prong 764 is configured to be resiliently depressed inwardly (toward the interior of the cap 762). The resilient prongs 764 may be used to facilitate attachment of the cap 762 to the housing 750. For example, the housing 750 can have orifices formed in the sides of the housing, e.g., orifice 766 formed in side 741 of housing 750, sized to receive an outwardly pointing notch of a respective cap prong 764.

The end cap 762 includes cap recesses 759 formed in sides 810, 814 of the cap. Each recess 759 formed in the sides 810, 814 corresponds and is generally alignable with a respective housing recess 756 formed in the sides 741, 745, respectively, of housing 750. The cap recesses 759 can be generally semicircular shaped to receive a wire, such as the portion of wire 760 bent towards the printed circuit board. The recess 759 can serve to guide, align and at least partially contain the wire 760, which can result in increased reliability and manufacturing efficiency.

The cap 762 is secured to outlet housing 750 at the open end of the housing 754 by inserting the outwardly pointing notches of the resilient prongs 764 into corresponding apertures 766 in the housing 750. The cap 762 can be removed by depressing the notches out of engagement with the apertures 766 and withdraw the cap from the housing 750.

With the power transmitting wires secured to respective socket terminals within the housing 750, the cap 762 can be secured to the housing 750 to at least partially retain the wires within the housing 750. Further, the cap 762 can be made of a non-conductive material to prevent inadvertent electrical contact between components within the PDU housing 720 and the components within the outlet housing 750. To assist in preventing inadvertent electrical contact with other components the wires, such as wire 758, can also be coated with a non-conductive material or include a non-conductive sleeve to prevent inadvertent electrical between the wires and other components within the PDU housing 720.

As can be recognized, the ganged-outlet 708 of FIGS. 9 and 10 can provide much of the same functionality and insulation as the ganged-outlet module 310 of FIGS. 1-8, but without a ganged-outlet housing, such as housing 311, described above. Accordingly, the ganged-outlet 708 occupies less space, which can allow for more components to be mounted to or positioned within the housing of a PDU system. Further, the ganged-outlet 708 can allow for flexible modification, such as by adding or removing individual outlets 712, without requiring modification to a ganged-outlet housing. Also, the ganged-outlet 708 can require less wire and labor to assemble in a PDU than that required for typical PDUs without ganged-outlets.

The ganged-outlets can have different housing and connector configurations than shown and described above in order to facilitate, for example, interconnection of multiple ganged-outlets together (e.g., in a single PDU system) while minimizing the amount of wiring required for delivering electrical power to the respective ganged-outlets. In other embodiments, the ganged-outlets in their housing or not can be used as a stand-alone ganged-outlet assembly. In yet other embodiments, each ganged-outlet can include additional electrical-connection capability between adjacent ganged-outlets to facilitate their interconnection with each other or otherwise to interconnect them electrically to provide the desired manner in which common, non-controlled power lines are connected to respective outlets of adjacent ganged-outlets.

Whereas the disclosure has been set forth above in the context of a representative embodiment and various alternative configurations of that embodiment, it will be understood that the invention is not limited to that embodiment. On the contrary, the invention is intended to encompass any and all embodiments falling within the spirit and scope of the appended claims.

What is claimed is:

1. An electrical ganged-outlet device mountable within an electrical equipment rack and connectable to be in power supplying communications with electrical devices in the rack, the electrical ganged-outlet device comprising in combination:

a plurality of NEMA compatible electrical power outlets each comprising at least one power-connection element electrically couplable to a respective electrical device;

at least one common power line electrically interconnecting the at least one power-connection element among the plurality of NEMA compatible electrical power outlets;

at least one separate, dedicated control power line electrically connected to a second power-connection element of each of the NEMA compatible electrical power outlets; and a printed circuit board comprising one or more power control relays and a relay controller, the printed circuit board electrically connected to a power source, wherein the at least one separate, dedicated control power line is coupled to a corresponding power control relay and electrically connected to the power source via the printed circuit board and power control relay, and wherein each power outlet of the plurality of electrical power outlets comprises a separate outlet housing having a connection terminal for the common power line that interconnects with the at least one common power line.

2. The electrical ganged-outlet device of claim 1, wherein one or more of the common power line and separate, dedicated control power lines comprise at least one flexible wire.

3. An electrical ganged-outlet device mountable in an electronic equipment rack and connectable in power supplying communication with electrical devices in the electronic equipment rack, the electrical ganged-outlet device comprising in combination:

a plurality of electrical power outlets each comprising at least first and second power-connection elements electrically couplable to a respective electrical device;

at least one common power line electrically interconnecting the first power connection elements among the plurality of electrical power outlets;

at least one separate, dedicated control power line electrically connected to the second power-connection element of each of at least one power outlet among the plurality of electrical power outlets; and a printed circuit board comprising one or more power control relays each connected to the power source and a relay controller, wherein the at least one separate, dedicated control power line is coupled to a corresponding power control relay, and wherein each power outlet of the plurality of electrical power outlets comprises a separate outlet housing, and wherein (i) the at least one common power line is connected to the first power-connection elements within respective outlet housings through a connection terminal for the common power line, and (ii) each of the at least one separate, dedicated control power line is connected to the second power-connection element of each of a respective at least one power outlet within the respective power outlet housing through a connection terminal for the control power line.

4. The electrical ganged-outlet device of claim 3, further comprising a power distribution unit housing with the separate outlet housings at least partially mounted within the power distribution unit housing.

5. The electrical ganged-outlet device of claim 3, wherein one or more of the common power line and separate, dedicated control power lines comprise at least one flexible wire.

6. An electrical ganged-outlet device mountable within an electrical equipment rack and connectable in power supplying communication with electrical devices in the rack, the electrical ganged-outlet device comprising in combination:

a plurality of electrical power outlets each comprising at least first and second power-connection elements electrically couplable to a respective electrical device;

at least one common power line electrically interconnecting the first power connection elements among the plurality of electrical power outlets;

at least one separate, dedicated control power line electrically connected to the second power-connection element of each of at least one power outlet among the plurality of electrical power outlets; and a printed circuit board comprising one or more power control relays and a relay controller, the printed circuit board electrically connected to a power source, wherein the at least one separate, dedicated control power line is coupled to a corresponding power control relay, and wherein power transmitted to the respective second power-connection element of the at least one power outlet via the at least one separate, dedicated control power line is selectively controllable, and wherein each power outlet of the plurality of electrical power outlets comprises a separate outlet housing, and wherein (i) the at least one common power line is connected to the first power-connection elements within respective outlet housings through a connection terminal for the common power line, and (ii) each of the at least one separate, dedicated control power line is connected to the second power-connection element of a respective power outlet within the respective power outlet housing through a connection terminal for the control power line.

7. The electrical ganged-outlet device of claim 6, wherein one or more of the common power line and separate, dedicated control power lines comprise at least one flexible wire.

8. An electrical ganged-outlet device mountable within an electrical equipment rack and connectable in power supplying communication with electrical devices in the rack, the electrical ganged-outlet device comprising in combination:

a plurality of electrical power outlets each comprising at least first and second power-connection elements electrically couplable to a respective electrical device;

at least one common power line electrically interconnecting the first power connection elements among the plurality of electrical power outlets;

at least one separate, dedicated control power line electrically connected to the second power-connection element of each of at least one power outlet among the plurality of electrical power outlets; and a printed circuit board electrically connected to a power source, wherein the at least one separate, dedicated control power line is coupled to the printed circuit board and electrically connected to the power source via the printed circuit board, the printed circuit board comprising one or more power control relays and a relay controller, wherein the at least one separate, dedicated control power line is coupled to the power source via a corresponding power control relay;

wherein power transmitted to the respective second power-connection element of the at least one power outlet via the at least one separate, dedicated control power line is selectively controllable;

wherein each power outlet of the plurality of electrical power outlets comprises a separate outlet housing, and wherein (i) the at least one common power line is connected to the first power-connection elements within respective outlet housings through a connection terminal for the common power line, and (ii) each of the at least one separate, dedicated control power line is connected to the second power-connection element of each of a respective at least one power outlet within the respective at least one power outlet housing through a connection terminal for the control power line and is electrically connected to the printed circuit board at a location external to the outlet housing.

9. The electrical ganged-outlet device of claim 8, wherein one or more of the common power line and separate, dedicated control power lines comprise at least one flexible wire.

10. An electrical ganged-outlet device mountable within an electrical equipment rack and connectable in power controlling communication with electrical devices in the rack, the electrical ganged-outlet device comprising in combination:

a plurality of electrical power outlets each comprising at least first and second power-connection elements electrically couplable to a respective electrical device;

at least one common power line electrically interconnecting the first power connection elements among the plurality of electrical power outlets;

at least one separate, dedicated control power line electrically connected to the second power-connection element of each of at least one power outlet among the plurality of electrical power outlets; and a printed circuit board comprising one or more power control relays and a microprocessor in relay control communication with the power control relays, the printed circuit board electrically connected to a power source, wherein the at least one separate, dedicated control power line is coupled to a corresponding power control relay such that the dedicated control power line is electrically connected to the power source via the printed circuit board and power control relay, and wherein at least one separate, dedicated control power line is electrically connected to the second power-connection element of each of the power outlets among the plurality of electrical power outlets, and wherein the separate, dedicated control power lines are each coupled to a printed circuit board such that the dedicated control power lines are each electrically connected to the power source via the printed circuit board, and wherein each power outlet of the plurality of electrical power outlets comprises a separate outlet housing, and wherein (i) the at least one common power line is connected to the first power-connection elements within respective outlet housings through a connection terminal for the common power line, and (ii) each of the at least one separate, dedicated control power line is connected to the second power-connection element of a respective power outlet within the respective power outlet housing through a connection terminal for the control power line and is electrically connected to the printed circuit board at a location external to the outlet housing.

11. The electrical ganged-outlet device of claim 10, wherein one or more of the common power line and separate, dedicated control power lines comprise at least one flexible wire.

12. A power distribution unit, comprising in combination:

a PDU-system housing; and at least one electrical ganged-outlet device penetrating the PDU-system housing for distributing power to electrical devices, the electrical ganged-outlet device comprising in combination:

(A) a plurality of electrical power outlets each comprising at least first and second power-connection elements electrically couplable to a respective electrical device;

(B) at least one common power line electrically interconnecting the first power connection elements among the plurality of electrical power outlets;

(C) at least one separate, dedicated control power line electrically connected to the second power-connection element of each of at least one power outlet among the plurality of electrical power outlets; and (D) a printed circuit board comprising one or more power control relays and a relay controller, the printed circuit board electrically connected to a power source, wherein the at least one separate, dedicated control power line is coupled to a corresponding power control relay and is electrically connected to the power source via the printed circuit board and power control relay, and wherein power transmitted to the respective second power-connection element of the at least one power outlet via the at least one separate, dedicated control power line is selectively controllable, and wherein each power outlet of the plurality of electrical power outlets comprises a separate outlet housing, and wherein (i) the at least one common power line is connected to the first power-connection elements within respective outlet housings through a connection terminal for the common power line, and (ii) each of the at least one separate, dedicated control power line is connected to the second power-connection element of each of a respective at least one power outlet within the respective power outlet housing through a connection terminal for the control power line.

13. The power distribution unit of claim 12, wherein the plurality of electrical power outlets comprise IEC-C13 compatible electrical power outlets, IEC-C19compatible electrical power outlets, NEMA compatible electrical power outlets, or a combination thereof.

14. The power distribution unit of claim 12, wherein one or more of the common power line and separate, dedicated control power lines comprise at least one flexible wire.

* * * * *

UNITED STATES PATENT AND TRADEMARK OFFICE

CERTIFICATE OF CORRECTION

PATENT NO. : 7,905,749 B2
APPLICATION NO. : 11/607185
DATED : March 15, 2011
INVENTOR(S) : Andrew J. Cleveland It is certified that error appears in the above-identified patent and that said Letters Patent is hereby corrected as shown below:

In the Detailed Description, Column 5, line 22, "various EC" should read --various IEC--.

Signed and Sealed this
Seventeenth Day of May, 2011

David J. Kappos

David J. Kappos
*Director of the United States Patent and Trademark Office*